United States Patent [19]

Braun et al.

[11] Patent Number: 4,458,648

[45] Date of Patent: Jul. 10, 1984

[54] FUEL INJECTION PUMP FOR INTERNAL COMBUSTION ENGINES

[75] Inventors: Wolfgang Braun, Ditzingen; Otmar Weiss, Stuttgart, both of Fed. Rep. of Germany

[73] Assignee: Robert Bosch GmbH, Stuttgart, Fed. Rep. of Germany

[21] Appl. No.: 408,978

[22] Filed: Aug. 17, 1982

[30] Foreign Application Priority Data

Sep. 16, 1981 [DE] Fed. Rep. of Germany ..... 3136689

[51] Int. Cl.[3] ..... F02M 41/00

[52] U.S. Cl. ..... 123/449; 123/459; 123/506

[58] Field of Search ..... 123/449, 459, 458, 198 DB, 123/506

[56] References Cited

U.S. PATENT DOCUMENTS

| | | | |
|---|---|---|---|
| 3,661,130 | 5/1972 | Eheim | 123/358 |
| 3,896,779 | 7/1975 | Omori et al. | 123/449 |
| 4,073,275 | 2/1978 | Hofer et al. | 123/449 |
| 4,164,921 | 8/1979 | Hofer et al. | 123/506 |
| 4,211,203 | 7/1980 | Kobayashi | 123/449 |
| 4,271,808 | 6/1981 | Kobayashi et al. | 123/449 |
| 4,327,696 | 5/1982 | Kobayashi et al. | 123/449 |

FOREIGN PATENT DOCUMENTS

| | | | |
|---|---|---|---|
| 102423 | 8/1979 | Japan | 123/449 |
| 134222 | 10/1979 | Japan | 123/449 |

*Primary Examiner*—Ira S. Lazarus
*Assistant Examiner*—Magdalen Moy
*Attorney, Agent, or Firm*—Edwin E. Greigg

[57] ABSTRACT

A fuel injection pump for internal combustion engines having an electrical shutoff device is proposed, in which an rpm limitation controlled in accordance with the supply pump pressure in the suction chamber is possible in the event that the failure of the rpm governor or of the annular slide disposed on the pump piston means that the pump work chamber can no longer be relieved in favor of the suction chamber. To this end, a control location dependent in the supply pump pressure in the suction chamber is provided, in the form of a relief slide valve, in a second relief line which leads from the pump work chamber to the suction chamber. The relief slide valve is subjected on one end to the supply pump pressure in the suction chamber and on the other end to the force of a compression spring, and upon the attainment of the maximum permissible rpm limit, the relief slide relieves the pump work chamber, thus automatically enabling a hydraulically controlled rpm limitation.

2 Claims, 2 Drawing Figures

FUEL INJECTION PUMP FOR INTERNAL COMBUSTION ENGINES

BACKGROUND OF THE INVENTION

The invention is based on a fuel injection pump for internal combustion engines, having a pump piston provided with control grooves and distributor grooves arranged to operate within a pump head, and wherein the respective grooves communicate with an intake conduit which leaks from a suction chamber to a pump work chamber, the pump also being provided with pressure lines leading to forechambers of the injection valves, and with a relief line leading through the pump piston to the suction chamber, and further having a governor slide movably disposed on the pump piston and arranged to control a relief conduit carried within the pump piston from the pump work chamber to the suction chamber, and also having an electrical shutoff device. In known fuel injection pumps of this kind, if the rpm governor (henceforth called simply "governor") which controls the governor slide on the pump piston fails, or if the governor slide seizes on the pump piston, it is no longer possible to open the relief conduit. As a result, the maximum permissible rpm of the fuel injection pump can no longer be adhered to via the governor. The internal combustion engine must then be shut off immediately via the electrical shutoff device and accordingly via the ignition key by the vehicle driver himself, in order to avoid an undesirable overspeeding of the engine. However, the disadvantage then is that the steering wheel locking mechanism may be turned on by the actuation of the ignition key, in which case the vehicle can no longer be controlled.

OBJECT AND SUMMARY OF THE INVENTION

The fuel injection pump according to the invention as revealed hereinafter has the advantage over the prior art that if the relief of the pump work chamber by means of the governor slide should fail, a second relief line is provided leading from the pump work chamber to the suction chamber via a control point dependent on the supply pump pressure in the suction chamber, assuring a hydraulically controlled rpm limitation. A further advantage is that the control point dependent on the supply pump pressure can be disposed at various locations on the pump head or at some other location, depending on the available space for accommodating the pump.

By means of the characteristics narrated herein advantageous further embodiments of the fuel injection pump disclosed in the application are possible. It is particularly advantageous that the control point dependent on supply pump pressure is embodied on a relief slide, which is provided with a further control point for controlling the relief line between the pressure lines and the suction chamber. As a result, upon the shutoff of the engine by the electrical shutoff device at low rpm, a residual quantity of fuel is prevented from being aspirated from the suction chamber via the respective pressure line connected with the relief line; this causes merely a reduction in the rpm of the engine, and does not absolutely necessarily cause the shutoff of the engine.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
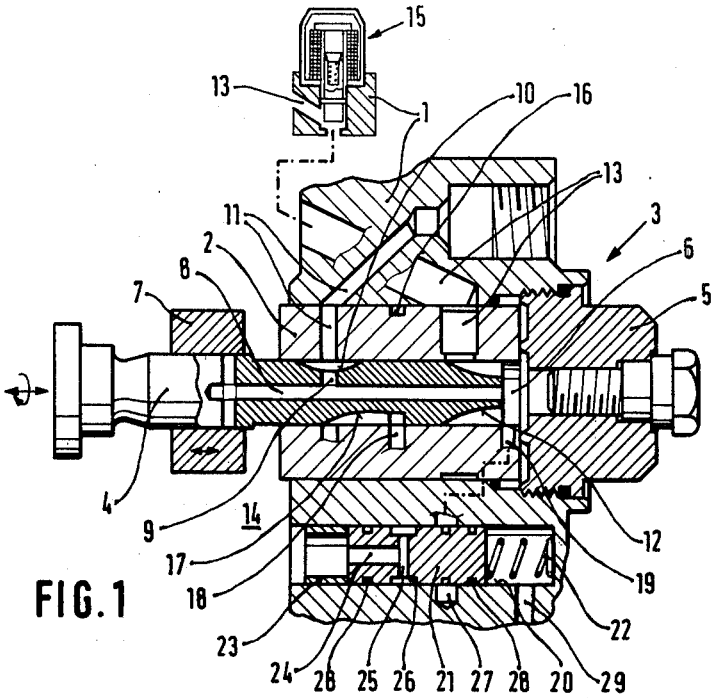
FIG. 1 shows a fragmentary portion of a fuel injection pump in longitudinal cross section.

A bushing 2 is inserted into a pump housing 1. The housing 1 and bushing 2 together form the pump head 3 of a fuel injection pump. A pump piston 4 operates within the bushing 2, executing simultaneously reciprocating and rotating movements at the impetus of means known per se and thus not shown further. A pump work chamber 6 is defined by the pump piston 4 and the bushing 2 and by a closure plug 5. The injection quantity is controlled by an annular slide 7, which is longitudinally displaceably disposed on the pump piston 4 and is displaceable by means of an rpm governor known per se and thus not shown further. By means of the annular slide 7, a relief conduit 8 of the pump work chamber which extends within the pump piston 4 is controlled; depending upon the axial length of the annular slide 7, the relief conduit 8 is either controlled, in the case of injection onset regulation, or opened, in the case of injection end regulation, during the compression stroke. A transverse bore 9 branches off from the relief conduit 8 and discharges into a distributor groove 10 embodied on the jacket of the pump piston 4. During the compression stroke of the pump piston 4, the distributor groove 10 is connected in sequence to various pressure lines 11 leading to forechambers (not shown) of the injection valves of the internal combustion engine. The pressure lines 11 correspond in number to the number of engine cylinders to be supplied with fuel, only one pressure line 11 at a time being opened up by the distributor groove 10. During the intake stroke of the pump piston 4, the pump work chamber 6 communicates via control grooves 12 in the pump piston 4 and via an intake conduit 13 in the pump head 3 (that is, the housing 1 and bushing 2) with a suction chamber 14. Fuel under supply pump pressure is located in the suction chamber 14. The intake conduit 13 can be blocked by means of an electrical shutoff device 15, by means of which a shutoff of the engine via the ignition key is made possible.

On its jacket, the pump piston 4 has an annular groove 16, which is adjoined in the longitudinal direction by a distributor groove 17. Via the annular groove 16, the distributor groove 17 communicates with a first relief line 18, which is carried through the pump housing 2 to the suction chamber 14 by the bore receiving the pump piston 4.

A second relief line 19 is carried through the bushing 2 and the pump housing 1 to a bore 20. The bore 20 extends parallel to the bushing 2 and discharges into the suction chamber 14. A relief slide valve 21 is accommodated in a longitudinally displaceable manner within the bore 20. A compression spring 22 also placed in the bore 20 is supported at one end on a stop in the bore 20 and rests with its other end against the relief slide valve 21, which is pressed by the compression spring 22 against an annular shoulder 23 in the end portion of the bore 20 oriented toward the suction chamber 14. The end face of the relief slide valve 21 oriented toward the suction chamber 14 is thus subjected to the supply pump pressure prevailing in the suction chamber 14. The relief slide valve 21, which is subjected at one end to the pressure in the suction chamber 14 and at the other to the force of the spring 22 controls the relief line 19 to the suction chamber 14 by means of a longitudinal bore 24, which communicates via a transverse bore 25 with an annular groove 26 in the jacket of the relief slide valve 21. Opposite the mouth of the relief line 19, the bore 20 is provided with a recess 27, while the relief slide valve 21 is provided on its jacket with annular grooves 28, which prevent the formation of pressure pockets at the relief slide valve 21. The portion of the bore 20 receiving the compression spring 22 is relieved via a relief conduit 29 toward the intake side of the fuel supply pump, not shown, or toward the pump discharge.

At normal rpm, the relief line 19 is blocked by the relief slide valve 21. The supply pump pressure prevailing in the suction chamber 14 is insufficient to displace the relief slide valve 21 far enough, counter to the force of the compression spring 22, that the relief line 19 could be connected to the suction chamber 14 via the annular groove 26. The relief of the pump work chamber 6 is effected by means of the relief conduit 8, controlled in accordance with rpm by the governor slide 7.

If the rpm governor fails or, for example, if the governor slide 7 should seize on the pump piston 4 such that it can no longer open the relief conduit 8, then the maximum permissible rpm of the fuel injection pump can no longer be adhered to via the governor. The fuel supply pump (not shown) supplies pressure medium in an uncontrolled manner to the suction chamber 14, in which the pressure continues to rise, and the relief slide valve 21 is displaced farther into the bore 20. Upon the attainment of the pressure in the suction chamber corresponding to the maximum permissible rpm, the annular groove 26 is connected to the relief conduit 19, and the pump work chamber 6 is relieved in favor of the suction chamber 14 via the connection 19, 26, 25, 24. The rpm level drops and is limited by means of the relief slide valve 21, which is hydraulically controlled in accordance with the supply pump pressure, without any action on the part of the driver of the vehicle.

Figure 2:
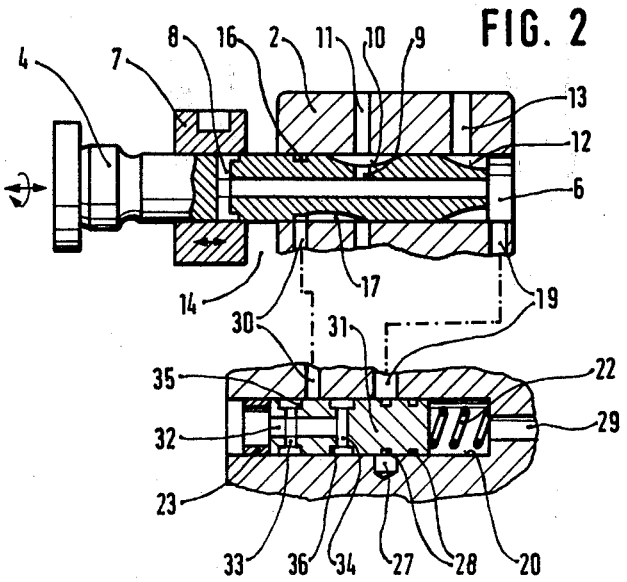
FIG. 2 shows a modification of the pump shown in FIG. 1.

In the modification of the fuel injection pump shown in FIG. 2, the elements which remain identical to those shown in FIG. 1 are provided with identical reference numerals.

The pump piston 4 carrying the annular slide 7 and having the control grooves 12, the distributor grooves 10 and 17, the relief conduit 8, the transverse bore 9 and the annular groove 16 operates as before in the pump head 3. A first relief line 30, which is connectable via the distributor groove 17 to the pressure lines 11, no longer discharges directly into the suction chamber 14 but instead again discharges within the bore 20 in the direction of the suction chamber 14, spaced apart axially from the mouth of the second relief line 19 of the pump work chamber 6. A relief slide valve 31 displaceably disposed in the bore 20 is exposed in turn at one end to the supply pump pressure and at the other to the force of the compression spring 22. Its longitudinal bore 32 is provided with two transverse bores 33 and 34, which discharge into associated annular grooves 35 and 36 in the jacket of the relief slide valve 31. The axial distance between the two transverse bores 33 and 34 is smaller than the distance between the mouths of the two relief lines 30 and 19 within the bore 20 receiving the relief slide valve 31.

In fuel injection pumps having an electrical shutoff device, at low rpm and a correspondingly low supply pump pressure in the suction chamber 14 the relief slide valve 31 is pressed by the compression spring 22 against the annular shoulder 23. In this position, both relief lines 30 and 19 are blocked. No residual fuel quantity can pass from the suction chamber 14 via the relief line 30 to the pressure lines 11. The engine can reliably be shut off with the electrical shutoff device, even at low rpm.

At increasing rpm up to the maximum permissible rpm, the relief slide valve 31 is displaced, in accordance with the higher supply pump pressure in the suction chamber 14, into the bore 20 counter to the force of the compression spring 22. The relief line 30 is thereby connected via the annular groove 35 and the bores 33, 32 with the suction chamber 14. The residual pressure in the respective forechamber of the injection valve in which the associated pressure line 11 terminates is equalized, in that the valve forechamber is relieved. The second relief line 19 remains blocked.

If the pump work chamber is unable to be relieved via the relief conduit 8, for instance as a consequence of the above-described situation involving the governor and the annular slide 7, then upon the attainment of the supply pump pressure in the suction chamber 14 corresponding to the maximum permissible rpm limit, the relief slide valve 31 is displaced, counter to the force of the compression spring 22, so far that both relief lines 30 and 19 are connected to the suction chamber 14. The relief of the valve forechambers by equalizing the "standing pressure", like the limitation of the maximum rpm limit, is controlled hydraulically, in accordance with the supply pump pressure in the suction chamber 14, by means of one common relief slide valve 31.

The relief slide valve 21 or 31 may be disposed equally well either in the pump housing 1 or in the bushing 2, or in other parts of the fuel injection pump as well, depending on existing space limitations.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A fuel injection pump for internal combustion engines having a reciprocably guided pump piston which thereby executes an intake stroke and a supply stroke and having a pump work chamber defined by said pump piston which upon the intake stroke of said pump piston can be made to communicate with a fuel suction chamber via at least one control opening disposed on a rotating part of said fuel injection pump driven in synchronism with the engine to be supplied with fuel and via a fuel supply conduit controlled by said control opening, and upon the supply stroke of said pump piston can be made to communicate in sequence, in the course of the rotation of said rotating part, with one at a time of a plurality of injection lines via a distributor groove disposed on said rotating part, further having a quantity adjusting device by means of which the effective supply stroke of said pump piston and thus the injected fuel injection quantity can be adjusted, wherein said quantity adjusting device is adjustable in its position by means of a regulator, wherein the improvement comprises a relief line leading from said pump chamber to said fuel suction chamber, said relief line being opened up directly by means of a valve closing member that is adjustable by the fuel pressure in said suction chamber counter to the force of a spring, the opening of said relief line being for the length of time during which a predetermined fuel pressure in said suction chamber is exceeded, and said valve closing member comprises a control piston, which is displaceable in a cylinder by the fuel pressure in said suction chamber counter to said spring and which on a jacket face thereof has a first control opening and, spaced axially apart therefrom, a second control opening, which both communicate continuously with said fuel suction chamber, and said relief line controlled by said first control opening discharges into said cylinder, while a second relief line discharges into said cylinder, said second relief line being opened up by said second control opening only beyond a minimum rpm and earlier than when said first relief line is opened up by said first control opening, wherein said second relief line is made to communicate alternatingly and in succession with said injection lines by means of a control groove on said rotating part, and that furthermore said fuel supply conduit is closable by means of an electrically actuatable valve.

2. A fuel injection pump as defined by claim 1, wherein said pump piston comprises a single pump piston that simultaneously reciprocates and rotates and on a jacket face thereof has said control opening controlling the fuel supply conduit, said control groove, and said distributor groove, said distributor groove communicating with a longitudinal conduit extending within said pump piston and communicating continuously with said pump work chamber, said longitudinal conduit exiting at said pump piston in a portion thereof protruding into said fuel suction chamber, wherein the exiting location is controllable by means of an annular slide, acting as said quantity adjusting device, which is tightly displaceable on said pump piston.

* * * * *